US008511874B2

(12) United States Patent
Nakada

(10) Patent No.: US 8,511,874 B2
(45) Date of Patent: Aug. 20, 2013

(54) VEHICLE LAMP

(75) Inventor: Yusuke Nakada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 604 days.

(21) Appl. No.: 12/687,995

(22) Filed: Jan. 15, 2010

(65) Prior Publication Data

US 2010/0202152 A1 Aug. 12, 2010

(30) Foreign Application Priority Data

Feb. 6, 2009 (JP) ..... 2009-026110

(51) Int. Cl.
*F21V 29/00* (2006.01)

(52) U.S. Cl.
USPC ..... 362/544; 362/543; 362/507; 362/525

(58) Field of Classification Search
USPC ..... 362/507, 512, 459, 487, 506, 525, 362/543–545
See application file for complete search history.

(56) References Cited

U.S. PATENT DOCUMENTS

| | | | | |
|---|---|---|---|---|
| 5,190,368 | A * | 3/1993 | Sekiguchi | 362/539 |
| 2004/0105275 | A1 * | 6/2004 | Sazuka et al. | 362/507 |
| 2005/0094413 | A1 | 5/2005 | Sazuka et al. | |
| 2005/0231971 | A1 | 10/2005 | Ishida | |

FOREIGN PATENT DOCUMENTS

| | | | |
|---|---|---|---|
| JP | 2005-141917 | A | 6/2005 |
| JP | 2005141919 | A | 6/2005 |
| JP | 2005294166 | A | 10/2005 |

OTHER PUBLICATIONS

Extended European Search Report, Application No. : 10152792.7, issued Jun. 14, 2010.
Notification of Reasons for Refusal dated Apr. 2, 2013 from the Japanese Patent Office in counterpart Japanese application No. 2009-026110.

* cited by examiner

*Primary Examiner* — Mary Ellen Bowman
(74) *Attorney, Agent, or Firm* — Sughrue Mion, PLLC

(57) ABSTRACT

A vehicle lamp includes a first lamp unit and a second lamp unit. Light irradiated from the first lamp unit and light irradiated from the second lamp unit are superimposed to form a low light distribution pattern. The first lamp unit provides more than twice as much illuminance as the second lamp unit.

15 Claims, 6 Drawing Sheets

VEHICLE LAMP

CROSS-REFERENCE TO RELATED APPLICATIONS

The present application claims priority from Japanese Patent Application No. 2009-026110 filed on Feb. 6, 2009, the entire content of which is incorporated herein by reference.

FIELD OF INVENTION

Apparatuses consistent with the present invention relate to a vehicle lamp which forms a low beam light distribution pattern by superimposing light irradiate from a plurality of lamp units.

DESCRIPTION OF RELATED ART

In some vehicle lamps, a light distribution pattern needs to be formed with high accuracy from the viewpoint of safety. The light distribution pattern is formed by an optical system which includes, for example, a reflector and/or a lens.

A related art vehicle lamp forms a light distribution pattern by superimposing light irradiated from a plurality of lamp units. For example, a vehicle headlamp described in JP 2005-141917A has a first lamp section, which forms a light distribution pattern for a low beam (a passing beam), and a second lamp section, which forms a light distribution pattern for a high beam (a driving beam). The first lamp section includes six lamp units, which are arranged in upper and lower rows with three lamp units in each of the upper and lower rows. Each of the lamp units has a semiconductor light emitting device as a light source. The second lamp section includes a single lamp unit having a discharge bulb as a light source.

In the related art vehicle headlamp described above, when a light source (e.g., a semiconductor light emitting device) of a lamp unit for a low beam can only emit a relatively small quantity of light, a number of lamp units are used in order to form the low beam. However, this increases power consumption. Moreover, a large space is required for arranging the lamp units, which increases design constraints.

BRIEF SUMMARY

Illustrative aspects of the present invention provides a vehicle lamp which can form a low beam light distribution pattern by superimposing light irradiated from a reduced number of lamp units.

According to an illustrative aspect of the present invention, a vehicle lamp is provided. The vehicle lamp includes a first lamp unit and a second lamp unit. Light irradiated from the first lamp unit and light irradiated from the second lamp unit are superimposed to form a low light distribution pattern. The first lamp unit provides more than twice as much illuminance as the second lamp unit.

Other aspects and advantages of the invention will be apparent from the following description, the drawings and the claims.

DETAILED DESCRIPTION

Hereinafter, an exemplary embodiment of the present invention will be described in detail with reference to the drawings.

Figure 1:
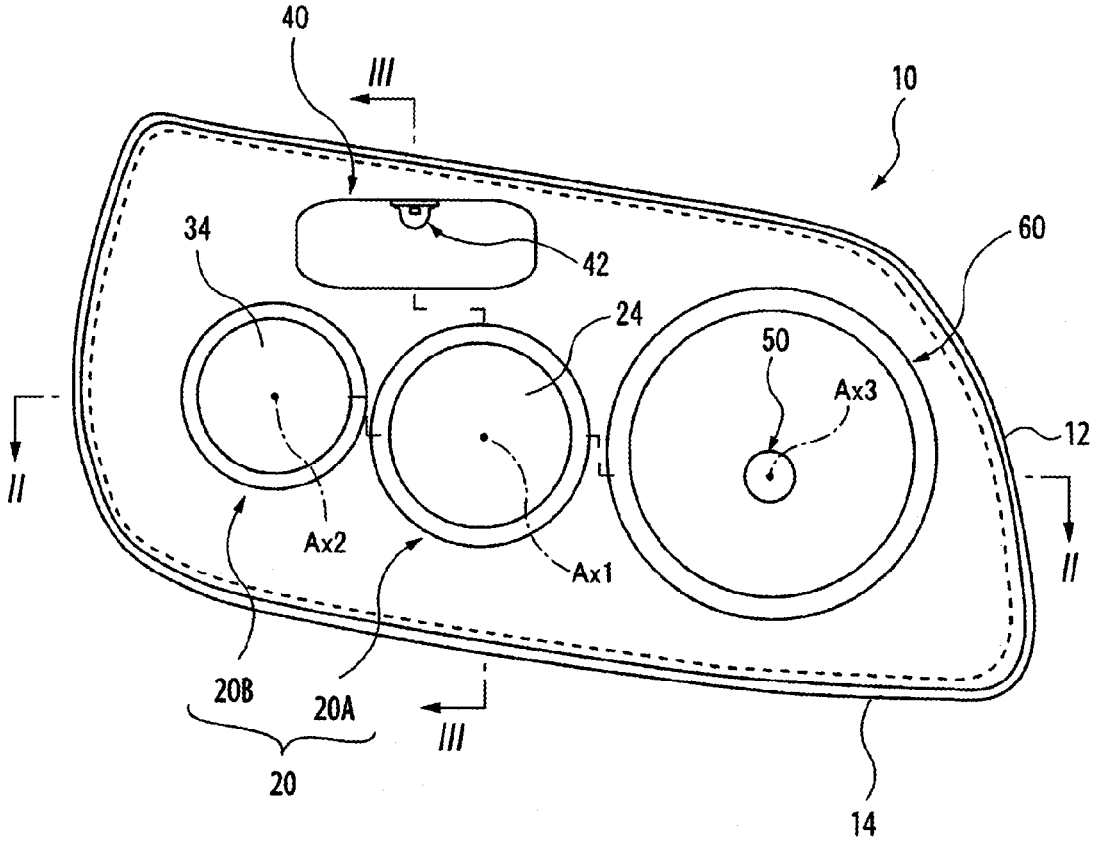
FIG. 1 is a front view of a vehicle lamp according to an exemplary embodiment of the present invention.

A vehicle lamp 10 according to the exemplary embodiment is a headlamp which is adapted to be mounted in a front end portion of a vehicle. The vehicle lamp 10 is configured such that a high beam and a low beam can be selectively switched to turn on and off. FIG. 1 shows, as an example of the vehicle lamp 10, a headlamp which is adapted to be mounted on the right of the front end portion of the vehicle such as an automobile.

Figure 2:
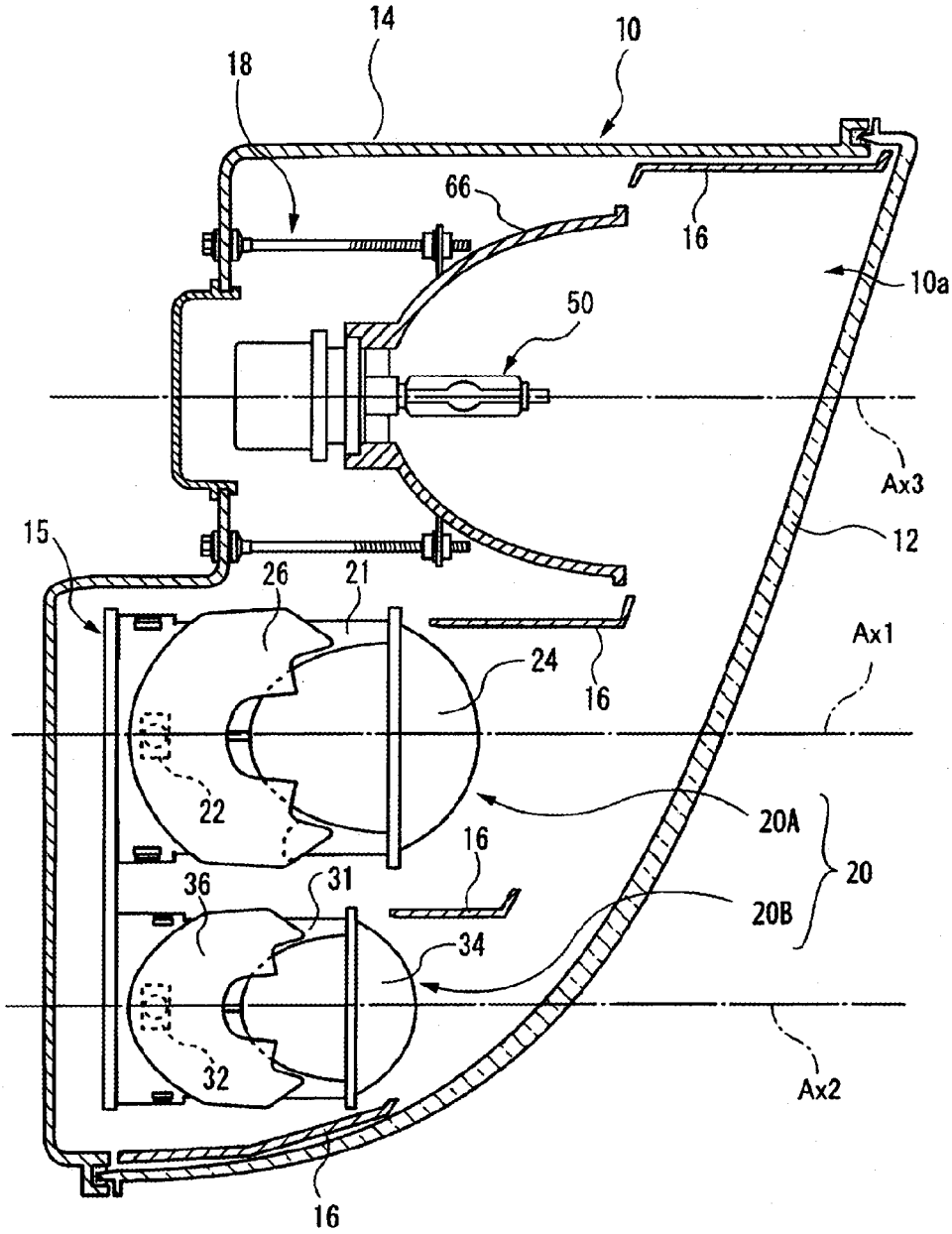
FIG. 2 is a horizontal sectional view of the vehicle lamp, taken along the line II-II in FIG. 1.
Figure 3:
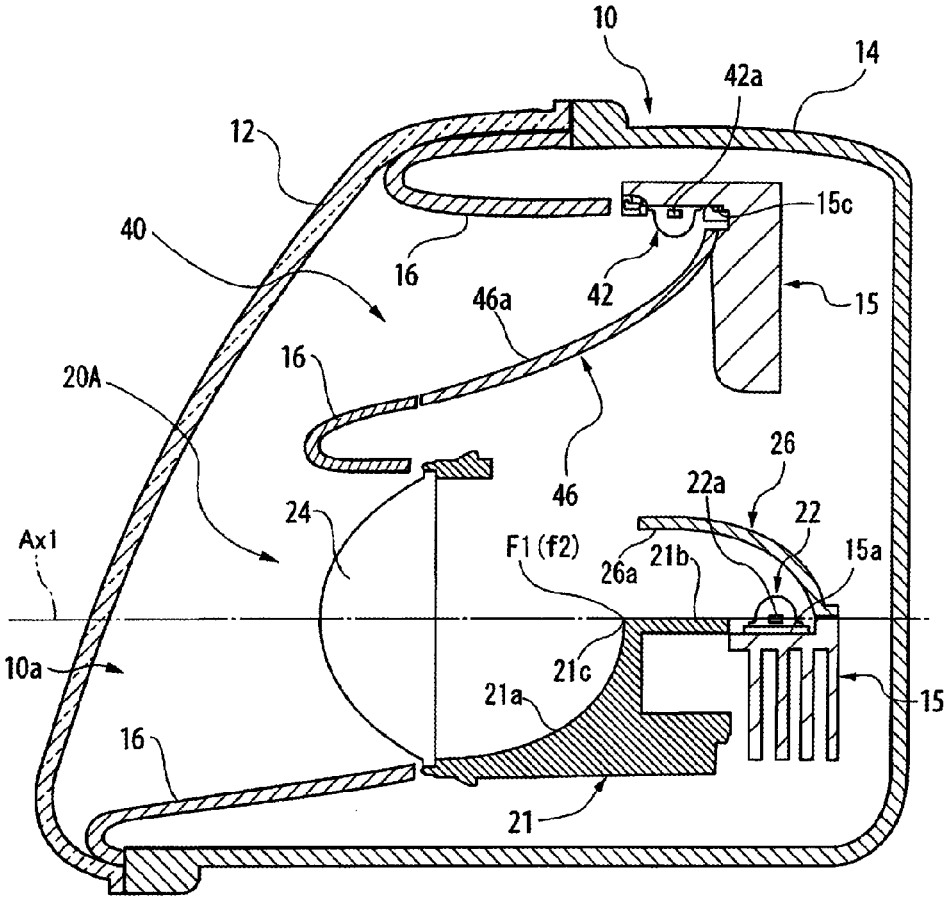
FIG. 3 is a vertical sectional view of the vehicle lamp, taken along the line III-III of FIG. 1.

As shown in FIGS. 1 to 3, the vehicle lamp 10 includes a transparent cover 12 and a lamp body 14. The transparent cover 12 and the lamp body 14 define a lamp chamber 10*a* inside which a first lamp section 20, a second lamp section 40, and a third lamp section 60 are arranged in a fixed manner. An extension 16 is disposed between the transparent cover 12 and the respective lamp sections 20, 40, 60 so as to cover a gap that would otherwise be seen from the front of the vehicle lamp 10.

The vehicle lamp 10 is configured such that a low beam light distribution pattern PL (see, FIG. 6) is formed by superimposing light irradiated from the first lamp section 20 and light irradiated from the second lamp section 40, and such that a high beam light distribution pattern is formed by light irradiated from the third lamp section 60.

The first lamp section 20 and the second lamp section 40 are fixed to a bracket 15 which is tiltable relative to the lamp body 14 via an aiming mechanism (not shown). The third lamp section 60 is tiltably fixed to the lamp body 14 via another aiming mechanism 18. Accordingly, optical axes of the respective lamp sections can be adjusted.

Next, each of the lamp sections 20, 40, 60 will be described.

The first lamp section 20 forms the low beam light distribution pattern PL together with the second lamp section 40. As shown in FIG. 1, the first lamp section 20 includes a first lamp unit 20A and a second lamp unit 20B, which are arranged side by side in a widthwise direction of the vehicle on a mounting portion at a lower part of the bracket 15.

Figure 4:
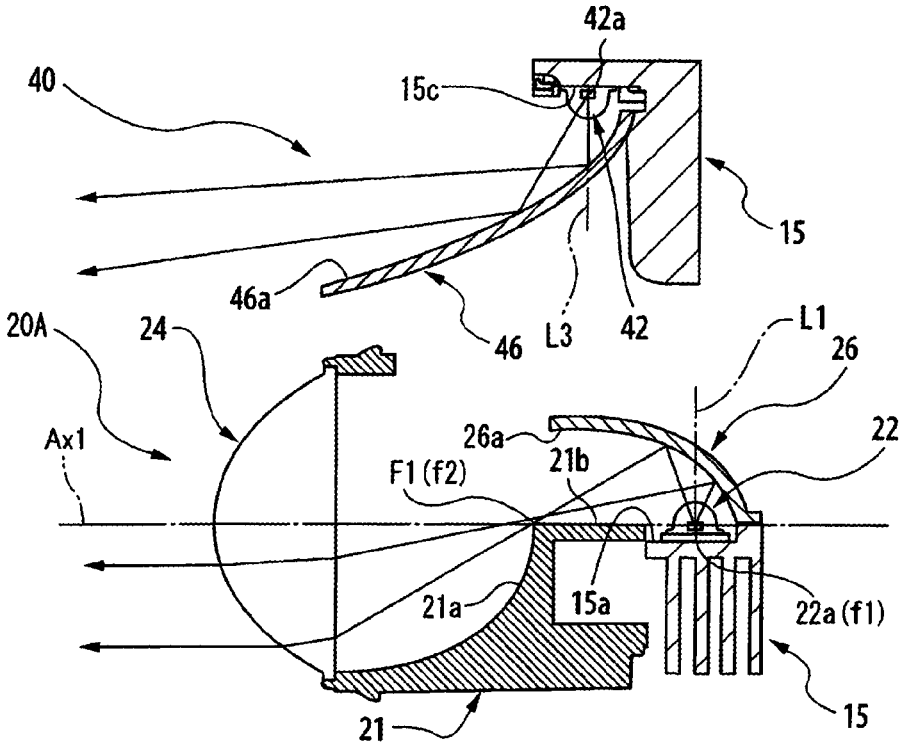
FIG. 4 is a vertical sectional view of a first lamp unit of a first lamp section and a second lamp section of the vehicle lamp.
Figure 6:
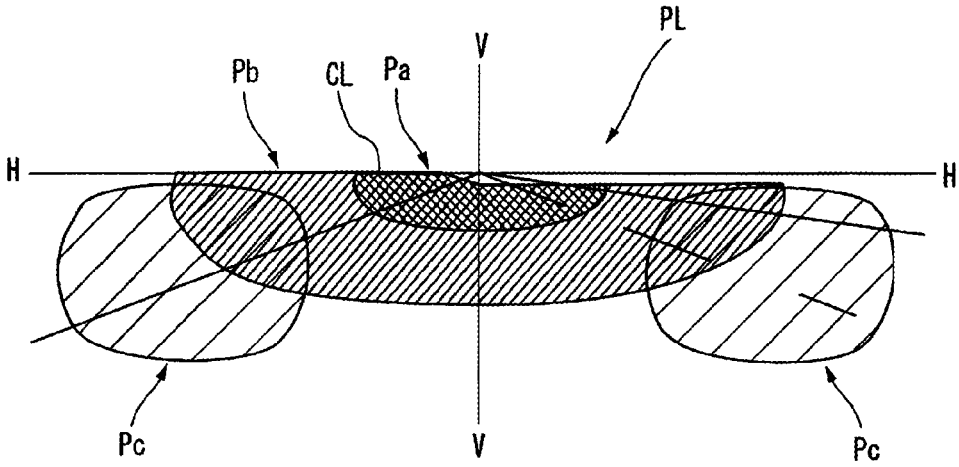
FIG. 6 is a perspective view of a low beam light distribution pattern which is formed by light irradiated from the vehicle lamp on an imaginary vertical screen disposed 25 m ahead of the vehicle lamp.

As shown in FIGS. 3 and 4, the first lamp unit 20A includes a first projection lens 24 disposed on a first optical axis Ax1 which extends in a front-rear direction of the vehicle, a first semiconductor light emitting device 22 (a first light source) which is disposed further toward the rear of the vehicle than a rear focal point F1 of the first projection lens 24, a first reflector 26 which forwardly reflects light from the first semiconductor light emitting device 22 to converge the light toward the first optical axis Ax1, and a first shade 21 which is disposed between the first projection lens 24 and the first semiconductor light emitting device 22 such that the first shade 21 shields a part of the light reflected by the first reflector 26 and a part of direct light from the first semiconductor light emitting device 22 to form a cutoff line CL of the low beam light distribution pattern PL (see FIG. 6).

The first semiconductor light emitting device 22 is a white light emitting diode having a light emitting portion 22*a* (a light emitting chip) whose size is about 1 $mm^2$. The first semiconductor light emitting device 22 is mounted on a support face 15*a* of the bracket 15 such that a light emitting axis L1 of the light emitting portion 22*a* is directed vertically upward so as to be substantially perpendicular to the first optical axis Ax1 of the first lamp unit 20A. The light emitting portion 22*a* may be disposed to slightly incline, depending on the shape of the light emitting portion 22*a* and/or an intended light distribution pattern to be irradiated. The first semiconductor light emitting device 22 may include more than one light emitting portion (i.e., a plurality of light emitting chips).

The first reflector 26 has a reflecting surface 26*a* on an inner side thereof. The reflecting surface 26*a* is curved such that a vertical sectional shape of the reflecting surface 26*a* is elliptic, and such that a horizontal sectional shape of the reflecting surface 26*a* is also ellipse-based. The first reflector 26 is configured and positioned such that a first focal point f1 of the first reflector 26 is located on or in the vicinity of the light emitting portion 22*a* of the first semiconductor light emitting device 22, and such that a second focal point f2 of the first reflector 26 is located on or in the vicinity of an edge line 21*c* along which a curved surface 21*a* and a horizontal surface 21*b* of the first shade 21 meet each other.

The light emitted from the light emitting portion 22*a* of the first semiconductor light emitting device 22 is reflected by the reflecting surface 26*a* of the first reflector 26 toward the second focal point 2*f*, and enters the first projection lens 24. The first lamp unit 20A is configured such that a part of the light is reflected by the horizontal surface 21*b* which is on the rear side of the edge line 21*c* of the first shade 21, so that the light is selectively cut to form the cutoff line CL, including an oblique line, of the low beam light distribution pattern PL that is forwardly projected from the vehicle lamp 10. That is, the edge line 21*c* constitutes a bright-dark boundary line in the first lamp unit 20A.

The part of light, which is reflected by the reflecting surface 26*a* of the first reflector 26 and further reflected by the horizontal plane 21*c* of the first shade 21, is also projected forward as an effective light. Accordingly, a front part of the horizontal surface 21*b* of the first shade 21 is configured to have an optical geometry in which a reflection angle is set in accordance with a positional relationship between the first projection lens 24 and the first reflector 26.

The first projection lens 24 is a convex aspheric lens which forwardly projects the light reflected by the reflecting surface 26*a* of the first reflector 26 from the vehicle lamp 10. The first projection lens 24 has, for example, a lens diameter of 60 mm and a rear focal length of 40 mm. The first projection lens 24 is fixed to a front end portion of the first shade 21. In this exemplary embodiment, the vehicle lamp 10 is configured such that the rear focal point F1 of the first projection lens 24 substantially coincides with the second focal point f2 of the first reflector 26.

Consequently, the light reflected by the first reflector 26 and entering the first projection lens 24 is projected toward a far zone ahead of the vehicle as substantially parallel light. That is, the first lamp unit 20A of the first lamp section 20 is configured as a projector-type lamp unit, which forms a concentrated light distribution pattern Pa with a cutoff line (see FIG. 6).

Figure 5:
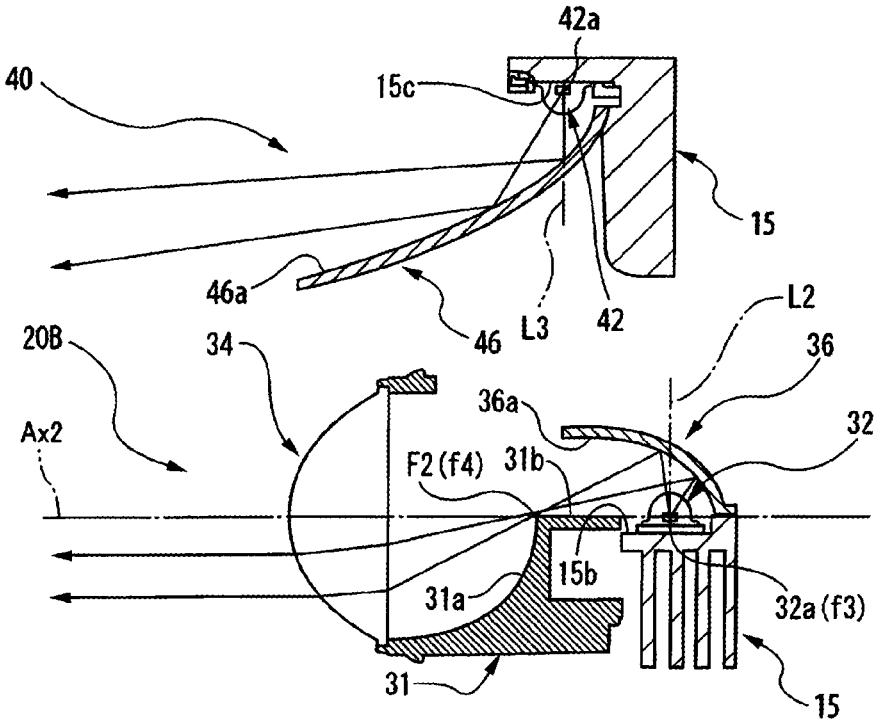
FIG. 5 is a vertical sectional view of a second lamp unit of the first lamp section and the second lamp section of the vehicle lamp.

As shown in FIG. 5, the second lamp unit 20B includes a second projection lens 34 disposed on a second optical axis Ax2, which extends in the front-rear direction of the vehicle, a second semiconductor light emitting device 32 (a second light source) which is disposed further toward the rear of the vehicle than a rear focal point F2 of the second projection lens 34, a second reflector 36 which forwardly reflects light from the second semiconductor light emitting device 32 to converge the light toward the second optical axis Ax2, and a second shade 31 which is disposed between the second projection lens 34 and the second semiconductor light emitting device 32 such that the second shade 31 shields a part of the light reflected by the second reflector 36 and a part of direct light from the second semiconductor light emitting device 32 to form the cutoff line CL of the low beam light distribution pattern PL. A rear focal length of the second projection lens 34 is shorter than the rear focal length of the first projection lens 24. The second semiconductor light emitting device 32 may have the same configuration as the first semiconductor light emitting device 22.

The second semiconductor light emitting device 32 is a white light emitting diode having a light emitting portion 32*a* like the first semiconductor light emitting device 22. The second semiconductor light emitting device 32 is mounted on a support face 15*b* of the bracket 15 such that a light emitting axis L2 of the light emitting portion 32*a* is directed vertically upward so as to be substantially perpendicular to the second optical axis Ax2 of the second lamp unit 20B.

The second reflector 36 has a reflecting surface 36*a* on an inner side thereof. The reflecting surface 36*a* is curved such that a vertical sectional shape of the reflecting surface 36*a* is elliptic, and such that a horizontal sectional shape of the reflecting surface 36*a* is also ellipse-based. The second reflector 36 is configured and positioned such that a first focal point f3 of the second reflector 36 is located on or in the vicinity of the light emitting portion 32*a* of the second semiconductor light emitting device 32, and such that a second focal point f4 of the second reflector 36 is located on or in the vicinity of an edge line 31*c* along which a curved surface 31*a* and a horizontal surface 31*b* of the second shade 31 meet each other.

The light emitted from the light emitting portion 32*a* of the second semiconductor light emitting device 32 is reflected by the reflecting surface 36*a* of the second reflector 36 toward the second focal point 4*f*, and enters the second projection lens 34. The second lamp unit 20B is configured such that a part of the light is reflected by the horizontal surface 31*b* which is on the rear side of the edge line 31*c* of the second shade 31, so that the light is selectively cut to form the cutoff line CL, which includes an oblique line, of the low beam light distribution pattern PL that is forwardly projected from the vehicle lamp 10. That is, the edge line 31*c* constitutes a bright-dark boundary line in the second lamp unit 20B.

The part of light, which is reflected by the reflecting surface 36*a* of the second reflector 36 and further reflected by the horizontal plane 31*c* of the second shade 31, is also projected forward as an effective light. Accordingly, a front part of the horizontal surface 31*b* of the second shade 31 is configured to have an optical geometry in which a reflection angle is set in accordance with a positional relationship between the second projection lens 34 and the second reflector 36.

The second projection lens 34 is a convex aspheric lens, which forwardly projects the light reflected by the reflecting surface 36*a* of the second reflector 36 from the vehicle lamp 10. The second projection lens 34 has, for example, a lens diameter of 50 mm and a rear focal length of 30 mm. The second projection lens 34 is fixed to a front end portion of the second shade 31. In this exemplary embodiment, the vehicle lamp 10 is configured such that the rear focal point F2 of the second projection lens 34 substantially coincides with the second focal point f4 of the second reflector 36.

Consequently, the light reflected by the second reflector 36 and entered the second projection lens 34 is laterally projected in front of the vehicle as substantially parallel light. That is, the second lamp unit 20B of the first lamp section 20 is configured as a projector-type lamp unit, which forms a diffused light distribution pattern Pb with a cutoff line (see FIG. 6).

Next, the second lamp section 40 will be described. The second lamp section 40 is a lamp unit, which forms the low beam light distribution pattern PL together with the first lamp section 20, and is disposed above the first lamp section 20.

As shown in FIGS. 3 to 5, the second lamp section 40 includes a third semiconductor light emitting device 42 which is fixed to a support face 15*c* of the bracket 15, and a third reflector 46 which forwardly reflects light from the third semiconductor light emitting device 42.

The third semiconductor light emitting device 42 is a white light emitting diode having a light emitting portion 42*a* like the first semiconductor light emitting device 22. The third semiconductor light emitting device 42 is mounted on the support face 15*c* of the bracket 15 such that a light emitting axis L3 of the light emitting portion 42*a* is directed vertically downward so as to be substantially perpendicular to an irradiating direction (a leftward direction in FIG. 4) of the second lamp section 40.

The third reflector 46 has a reflecting surface 46*a* on an inner side thereof. The third reflector 46 is configured and positioned such that the reflecting surface 46*a* has a paraboloidal reference surface whose focal point is located on or in the vicinity of the light emitting portion 42*a*. The light emitted from the light emitting portion 42*a* of the third semiconductor light emitting device 42 is reflected by the reflecting surface 46*a* of the third reflector 46 and is diffused to irradiate a region corresponding to a side periphery of the low beam light distribution pattern PL. That is, the second lamp section 40 is configured as a paraboloidal reflector-type lamp unit for irradiating a side periphery of the low beam light distribution pattern PL.

Next, the third lamp section 60 will be described. The third lamp section 60 is a lamp unit, which forms a high beam light distribution pattern. As shown in FIGS. 1 and 2, the third lamp section includes a paraboloidal reflector 66, which is installed such that a third optical axis Ax3 is tiltable via the aiming mechanism 18, and a discharge bulb 50 which is detachably fitted from the rear of the reflector 66 into a bulb mounting hole at the center of the reflector 66. That is, the third lamp section 60 is configured as a paraboloidal reflector-type lamp unit using a lamp bulb as a light source.

As described above, with regard to the first lamp section 20, the rear focal length of the first projection lens 24 of the first lamp unit 20A is longer than the rear focal length of the second projection lens 34 of the second lamp unit 20B, and the lens diameter of the first projection lens 24 is larger than the lens diameter of the second projection lens 34. Further, the first lamp section 20 is configured such that an illuminance provided by the first lamp unit 20A is at least twice as much as an illuminance provided by the second lamp unit 20B.

Because the rear focal length of the first projection lens 24 is longer than the rear focal length of the second projection lens 34, an image of the first semiconductor light emitting device 22 is projected through the first projection lens 24 and onto an imaginary vertical screen disposed ahead of the vehicle lamp 10 is smaller than an image of the second semiconductor light emitting device 32 that is projected on the imaginary vertical screen through the second projection lens 34.

Accordingly, as shown in FIG. 6, the far zone pattern Pa of the low beam light distribution pattern PL, which is formed by the first lamp unit 20A, is smaller than a lateral zone pattern Pb of the low beam light distribution pattern PL, which formed by the second lamp unit 20B. Thus, it is possible to collect the light in a region near the cutoff line CL of the low beam light distribution pattern PL. Therefore, even when the first light emitting device 22 of the first lamp unit 20A has the same configuration (the same quantity of emitting light) as the second light emitting device 32 of the second lamp unit 20B, the first lamp unit 20A can provide more than twice as much illuminance as the second lamp unit 20B.

Further, the lens diameter of the first projection lens 24 is larger than the lens diameter of the second projection lens 34 by a length corresponding to the length by which the rear focal length of the first projection lens 24 is longer than the rear focal length of the second projection lens 34. This allows a quantity of light projected from the first lamp unit 20A to be made equal to a quantity of light projected from the second lamp unit 20B.

Consequently, the first lamp section 20 can ensure far zone illuminance, which greatly affects visibility, by using the first lamp unit 20A, which provides more than twice as much illuminance as the second lamp unit 20B, and can also ensure the lateral illuminance by using the second lamp unit 20B.

That is, according to the first lamp section 20, the visibility for the driver is improved by increasing the far zone illuminance. Therefore, it is possible to form the low beam light distribution pattern PL having excellent visibility with a minimum quantity of light irradiated from the first semiconductor element 22 and the second semiconductor element 42, i.e. without unnecessarily increasing the quantity of irradiation light of the entire lamp by increasing the number of lamp units.

Further, according to the first lamp section 20, as shown in FIG. 1, the second optical axis Ax2 of the second lamp unit 20B, which has the smaller lens diameter, is positioned above the first optical axis Ax1 of the first lamp unit 20A, which has the larger lens diameter. Thus, the second lamp unit 20B forms the lateral zone pattern Pb by downwardly projecting the light toward the lateral zone in front of the vehicle lamp and below the horizontal line H-H from a position higher than the first lamp unit 20A, which has a higher level of concentration of the light and which serves as a reference for optical axis adjustment, whereby an oncoming vehicle can be prevented from being blinded.

Consequently, according to the first lamp section 20 of the exemplary embodiment described above, it is possible to provide a compact vehicle lamp 10 which can form a sufficient and favorable low beam light distribution pattern PL by superimposing the irradiation light from a minimum number of lamp units, namely, the first and second lamp units 20A, 20B.

Further, according to the exemplary embodiment, the second lamp section 40 is disposed above the first lamp section 20, which has a higher level of concentration of the light as compared with the second lamp section 40. Thus, the second lamp section 40 of each of the vehicle lamps mounted on right and left front portions of the vehicle forms a respective peripheral zone pattern Pc on right and left regions in front of the vehicle (see FIG. 6) by sending out the diffused light toward a near sideways region in front of the vehicle and below the horizontal line H-H, from a position above the first lamp section 20, which serves as the reference for the optical axis adjustment, whereby the peripheral field of view such as the road surface in front of the vehicle can be expanded without blinding an oncoming vehicle.

Further, because the second lamp section 40 is arranged such that the light emitting axis L3 of the third semiconductor light emitting device 42 is directed vertically downward from a position above the third reflector 46, other components of the vehicle lamp such as a lighting circuit can be arranged between the first lamp section 20 and the second lamp section without obstructing the overall layout.

Thus, the first lamp section 20 and the second lamp section 40 can be arranged with a minimum gap therebetween, whereby a luminous area of the first lamp section 20 and a luminous area of the second lamp section 40 are apparently recognized as a single luminous area. As a result, pedestrians recognize the first lamp section 20 and the second lamp section 40 as a single luminous portion and, thus, recognizability of the vehicle lamp can be enhanced as a whole so that it can improve safety.

According to the exemplary embodiment, the first light source of the first lamp unit 20A and the second light source of the second lamp unit 20B are the first semiconductor light emitting device 22 and the second semiconductor light emitting device 32, respectively. By using the semiconductor light emitting devices 22, 32, such as light emitting diodes (LEDs), which are small in size and which consumes less electric power in general, an effective use of limited electric power can be implemented.

Nevertheless, discharge bulbs, such as a metal halide bulb having a discharge light emitting portion as a light source, or halogen bulbs can also be used as the first light source and the second light source of the vehicle lamp of the present invention. However, the vehicle lamp according to embodiments of the present invention become more advantageous when the plurality of lamp units, each having as the light source a semiconductor light emitting device whose luminous intensity is smaller than that of a light emitting bulb, are used to form the low beam.

In the vehicle lamp 10 of the exemplary embodiment, the low beam light distribution pattern PL is formed by superimposing the irradiation light from the second lamp section 40 in addition to the irradiation light from the first and second lamp units 20A, 20B. However, a sufficient and complete low beam light distribution pattern can be formed without the second lamp section 40.

While the present invention has been described with reference to a certain exemplary embodiment thereof, it will be understood by those skilled in the art that various changes and modifications may be made therein without departing from the spirit and scope of the present invention as defined by the appended claims.

What is claimed is:

1. A vehicle lamp comprising a first lamp unit and a second lamp unit, wherein light irradiated from the first lamp unit and light irradiated from the second lamp unit are superimposed to form a low light distribution pattern, wherein the first lamp unit provides more than twice as much illuminance as the second lamp unit, wherein a second optical axis of the second lamp unit extends above a first optical axis of the first lamp unit, wherein the first lamp unit is configured to form a far zone pattern, wherein the second lamp unit is configured to form a lateral zone pattern, and wherein the first lamp unit and the second lamp unit are arranged side by side in a widthwise direction of the vehicle.

2. The vehicle lamp according to claim 1, wherein the first lamp unit comprises:

a first projection lens, which is disposed on the first optical axis extending in a front-rear direction of a vehicle;

a first light source, which is disposed further toward the rear of a rear focal point of the first projection lens;

a first reflector, which forwardly reflects light from the first light source to converge the light toward the first optical axis; and a first shade, which is disposed between the first projection lens and the first light source such that the first shade shields a part of the light reflected by the first reflector and a part of direct light from the first light source to form a cutoff line of the low beam light distribution pattern, and wherein the second lamp unit comprises:

a second projection lens, which is disposed on the second optical axis extending in the front-rear direction of the vehicle;

a second light source, which is disposed further toward the rear of a rear focal point of the second projection lens;

a second reflector, which forwardly reflects light from the second light source to converge the light toward the second optical axis; and a second shade, which is disposed between the second projection lens and the second light source such that the second shade shields a part of the light reflected by the second reflector and a part of direct light from the second light source to form the cutoff line of the low beam light distribution pattern.

3. The vehicle lamp according to claim 2, wherein a lens diameter of the first projection lens is larger than a lens diameter of the second projection lens.

4. The vehicle lamp according to claim 2, wherein the first light source and the second light source have the same configuration.

5. The vehicle lamp according to claim 2, wherein the first and second light sources are semiconductor light emitting devices.

6. The vehicle lamp according to claim 1, further comprising a third lamp unit having a lower level of concentration of light than the first and second lamp units, and wherein the third lamp unit is arranged above the first and second lamp units to provide diffused light.

7. The vehicle lamp according to claim 6, wherein the third lamp unit provides a periphery zone pattern on right and left regions of the low beam light distribution pattern.

8. The vehicle lamp according to claim 1, wherein the low beam light distribution pattern is formed only by the first and second lamp units.

9. A vehicle lamp comprising a first lamp unit and, a second lamp unit, and a third lamp unit, wherein the first lamp unit comprises:

a first projection lens, which is disposed on the first optical axis extending in a front-rear direction of a vehicle; and a first light source, which is disposed further toward the rear of a rear focal point of the first projection lens;

wherein the second lamp unit comprises:

a second projection lens, which is disposed on the second optical axis extending in the front-rear direction of the vehicle; and a second light source, which is disposed further toward the rear of a rear focal point of the second projection lens;

wherein light irradiated from the first lamp unit and light irradiated from the second lamp unit are superimposed to form a low light distribution pattern, and wherein the first lamp unit provides more than twice as much illuminance as the second lamp unit, wherein a second optical axis of the second lamp unit extends above a first optical axis of the first lamp unit, wherein the third lamp unit has a lower level of concentration of light than the first and second lamp units, wherein the third lamp unit is arranged above the first and second lamp units to provide diffused light, and wherein a lens diameter of the first projection lens is larger than a lens diameter of the second projection lens.

10. The vehicle lamp according to claim 9, wherein the third lamp unit provides a periphery zone pattern on right and left regions of the low beam light distribution pattern.

11. The vehicle lamp according to claim 9, wherein the low beam light distribution pattern is formed only by the first and second lamp units.

12. A vehicle lamp comprising a first lamp unit and a second lamp unit, wherein light irradiated from the first lamp unit and light irradiated from the second lamp unit are superimposed to form a low light distribution pattern, wherein the first lamp unit provides more than twice as much illuminance as the second lamp unit, wherein a second optical axis of the second lamp unit extends above a first optical axis of the first lamp unit, wherein the first lamp unit is configured to form a far zone pattern, wherein the second lamp unit is configured to form a lateral zone pattern, wherein the first lamp unit comprises:

a first projection lens, which is disposed on the first optical axis extending in a front-rear direction of a vehicle;

a first light source, which is disposed further toward the rear of a rear focal point of the first projection lens;

wherein the second lamp unit comprises:

a second projection lens, which is disposed on the second optical axis extending in the front-rear direction of the vehicle;

a second light source, which is disposed further toward the rear of a rear focal point of the second projection lens;

wherein a lens diameter of the first projection lens is larger than a lens diameter of the second projection lens, and wherein the lens diameter of the first projection lens is larger than the lens diameter of the second projection lens by a length corresponding to a length by which a rear focal length of the first projection lens is longer than a rear focal length of the second projection lens.

13. The vehicle lamp according to claim 9, wherein a light emitting axis of a light emitting device of the third lamp unit is directed vertically downward from a position above a third reflector which reflects light emitted from a light emitting device of the third reflector.

14. The vehicle lamp according to claim 9, wherein the lens diameter of the first projection lens is larger than the lens diameter of the second projection lens by a length corresponding to a length by which a rear focal length of the first projection lens is longer than a rear focal length of the second projection lens.

15. The vehicle lamp according to claim 9, wherein the first lamp unit and the second lamp unit are arranged side by side in a widthwise direction of the vehicle.

* * * * *